US009483919B2

(12) United States Patent
Di Giovine

(10) Patent No.: US 9,483,919 B2
(45) Date of Patent: Nov. 1, 2016

(54) LIGHT INDICATOR

(71) Applicant: COMBUSTION AND ENERGY S.r.l., Oggiono (LC) (IT)

(72) Inventor: Vincenzo Di Giovine, Lecco (IT)

(73) Assignee: COMBUSTION AND ENERGY S.R.L., Oggiono(LC) (IT)

( * ) Notice: Subject to any disclaimer, the term of this patent is extended or adjusted under 35 U.S.C. 154(b) by 232 days.

(21) Appl. No.: 14/506,707

(22) Filed: Oct. 6, 2014

(65) Prior Publication Data

US 2015/0097692 A1 Apr. 9, 2015

(30) Foreign Application Priority Data

Oct. 8, 2013 (IT) ..... PD20130053 U

(51) Int. Cl.
*G08B 5/22* (2006.01)
*G08B 5/36* (2006.01)

(52) U.S. Cl.
CPC ..... *G08B 5/36* (2013.01)

(58) Field of Classification Search
CPC ..... G08B 5/36; G08B 5/38
USPC ..... 340/815.4, 815.45
See application file for complete search history.

(56) References Cited

U.S. PATENT DOCUMENTS 7,011,431 B2 * 3/2006 Ono ..... F21V 3/00 362/241
7,270,446 B2 * 9/2007 Chang ..... F21K 9/00 362/294
7,494,248 B2 * 2/2009 Li ..... F21V 29/004 362/294
8,602,609 B2 * 12/2013 Yun ..... F21S 4/28 362/294
8,733,980 B2 * 5/2014 Cook ..... F21V 3/04 362/249.02
8,766,815 B2 * 7/2014 Di Giovine ..... F21V 29/83 320/108
2007/0164875 A1 * 7/2007 Fredericks ..... B64D 47/06 340/815.45
2009/0284381 A1 * 11/2009 Manahan ..... G08B 5/36 340/590
2012/0146813 A1 * 6/2012 Gilmore ..... G08B 7/066 340/907
2013/0088871 A1 4/2013 Yun et al.
2013/0100662 A1 * 4/2013 Lin ..... F21V 29/225 362/235

FOREIGN PATENT DOCUMENTS

EP 2565519 3/2013
WO 2011066421 6/2011

* cited by examiner

*Primary Examiner* — Eric M Blount
(74) *Attorney, Agent, or Firm* — Mark M. Friedman

(57) ABSTRACT

Light indicator which comprises a support structure provided with multiple seats, each of which housing at its interior rows of LEDs and a power supply circuit providing electrical power supply to the LEDs. The light indicator also comprises collimation lenses each positioned in front of the corresponding row of LEDs, and an insulating material layer deposited in each seat to cover the power supply circuit. Each lens extends parallel to the corresponding row of LEDs, and on the rear part is provided with an abutment portion fixed on the base surface of the seat and provided with a rear groove housing the row of LEDs. The abutment portion of each lens is closed transversely and longitudinally by longitudinal and transverse walls defining a rear edge which adheres to the base surface of the seat in order to prevent the insulating material from penetrating into the rear groove.

19 Claims, 6 Drawing Sheets

LIGHT INDICATOR

FIELD OF APPLICATION

The present finding refers to a light indicator, according to the preamble of the independent claim number 1.

The present light indicator is inserted in the industrial field of production of signaling apparatuses and installations provided with light sources of LED type, and it is intended to be advantageously employed in environments with high fire or explosion risk (such as petrochemical plants, mining plants, lubricant deposits, silos, etc.) in particular in order to indicate to aircraft the presence of high structures, such as smokestacks, bridges etc.

STATE OF THE ART

As is known, there is widespread use of light indicators, mounted for example on towers, on smokestacks, on industrial plant and factory buildings, or on bridges, pylons etc., in order to indicate the presence of aerial obstacles to vehicles such as airplanes and helicopters.

In particular, there is increasing need to use light indicators on high structures of industrial plants with areas at high risk of explosion, i.e. with areas in which inflammable substances are present in the air during normal plant operation conditions, or even only during exceptional operating conditions such as in case of plant failure or malfunction. Such inflammable substances can be constituted by inflammable or combustible gases (present for example in petrochemical plants, in natural gas extraction plants, in refineries etc.), or by combustible powders (present for example in the industries for producing plastic materials, in the pharmaceutical industries, in mining plants etc.), or by inflammable fibers (present for example in the textile fiber industries).

As is known, the indicators intended to operate in environments with high explosion risk comprise a hermetically-sealed and explosion-proof containment body, in which the electrical and electronic components of the indicator are housed. Such containment body prevents the inflammable substances present in the environment from coming into contact with the electrical and electronic components of the indicator, since the latter are susceptible of generating, during the operation thereof, sparks or electric arcs that could trigger the explosion of the inflammable substances.

In addition, the containment body prevents the propagation into the external environment of possible explosions that in any case occur inside the light indicator, due to the penetration of the inflammable substances into the containment body for example during indicator maintenance operations which require opening the containment body itself.

More in detail, the containment body of the light indicators of known type for environments at risk of explosion typically comprises a metal base, with circular form, on which light sources of LED type are mounted along with the electric and electronic circuits for the power supply and control of the LEDs themselves. The aforesaid metal base is closed on the upper part by a transparent cap, which is sealingly fixed on the metal base itself.

The transparent cap is made of transparent and explosion-proof material and is provided with a lower peripheral edge fixed, by means of for example plastic glues, to a tubular plate sealingly fixed to and abutted against a peripheral edge of the support base. More in detail, the tubular plate of the closure cap is screwed by means of its threaded wall to a counter-threaded mouth of the peripheral edge of the metal base.

The main drawback of the light indicators of known type described briefly above lies in the fact that the containment body for preventing the infiltration of the explosive gases renders such indicators structurally complex and costly to make.

A further drawback is due to the fact that the containment body of the indicators of known type has considerable size and bulk, making the installation operations particularly difficult and inconvenient, as these are normally carried out in hard-to-access settings such as the top of towers, smokestacks etc.

A further drawback is due to the fact that the containment body must still be provided with holes for the passage of the electrical cables that supply power to the LEDs, requiring the use of specific cable glands inserted inside the aforesaid holes and sealingly tightened around the corresponding electrical power supply cables, with consequent increase of production costs.

Presentation of the Finding

In this situation, the main object of the present finding is therefore to overcome the drawbacks shown by the solutions of known type, by providing a light indicator for settings with high explosion risk which is structurally simple and inexpensive to make.

Further object of the present finding is to provide a light indicator that is capable of operating in an efficient and reliable manner in settings with high explosion risk.

Further object of the present finding is to provide a light indicator with limited size and weight.

Further object of the present finding is to provide a light indicator that is capable of efficiently removing the heat generated by the LEDs.

BRIEF DESCRIPTION OF THE DRAWINGS

The technical characteristics of the finding, according to the aforesaid objects, can be clearly found in the contents of the below-reported claims and the advantages thereof are more evident in the following detailed description, made with reference to the enclosed drawings, which represent a merely exemplifying and non-limiting embodiment of the invention, in which:

DETAILED DESCRIPTION OF A PREFERRED EMBODIMENT

Figure 1:
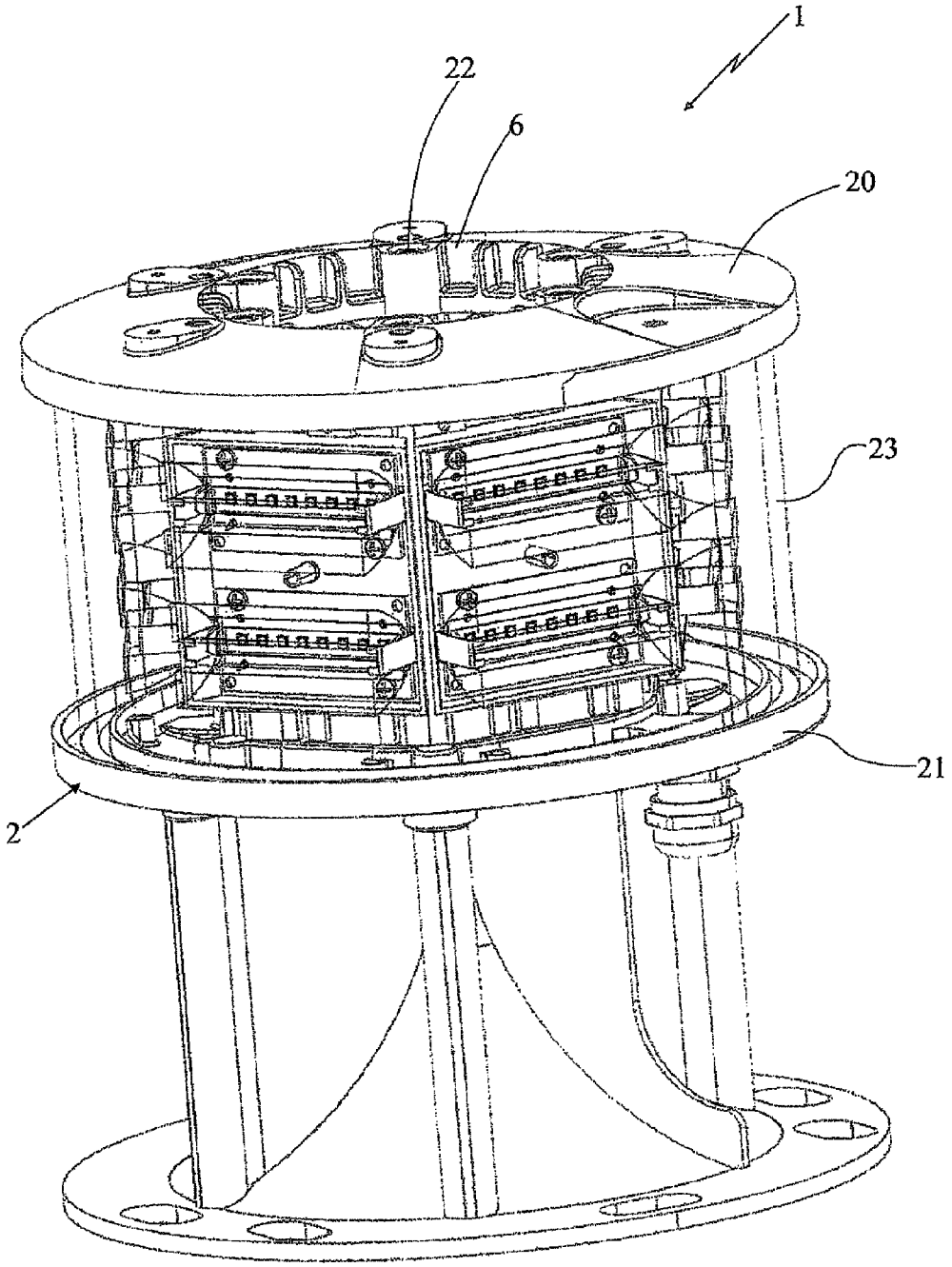
FIG. 1 shows a perspective view of the light indicator, subject of the present finding.

With reference to the set of drawings, reference number 1 indicates overall the light indicator that is the subject of the present invention.

The present light indicator 1 is intended to be advantageously employed in settings with high explosion risk, such as petrochemical plants, natural gas extraction plants, refineries, textile products industries, plastic materials industries, pharmaceutical industries, mines.

In particular, the light indicator 1 is intended to be mounted on high structures (such as towers, smokestacks etc.) of the industrial plants, in order to indicate the presence of aerial obstacles to vehicles such as airplanes and helicopters.

With reference to the enclosed figures, the light indicator 1 comprises a support structure 2 provided with at least one concave seat 3 delimited on the bottom by a base surface 4 that is at least partially flat, and at least one row of LEDs 5 mounted on the aforesaid base surface 4.

More in detail, the LEDs 5 of the corresponding row are arranged substantially aligned with each other along an alignment direction X parallel to the base surface 4, each LED provided with its light emission axis Y orthogonal to the base surface 4 itself.

Figure 2:
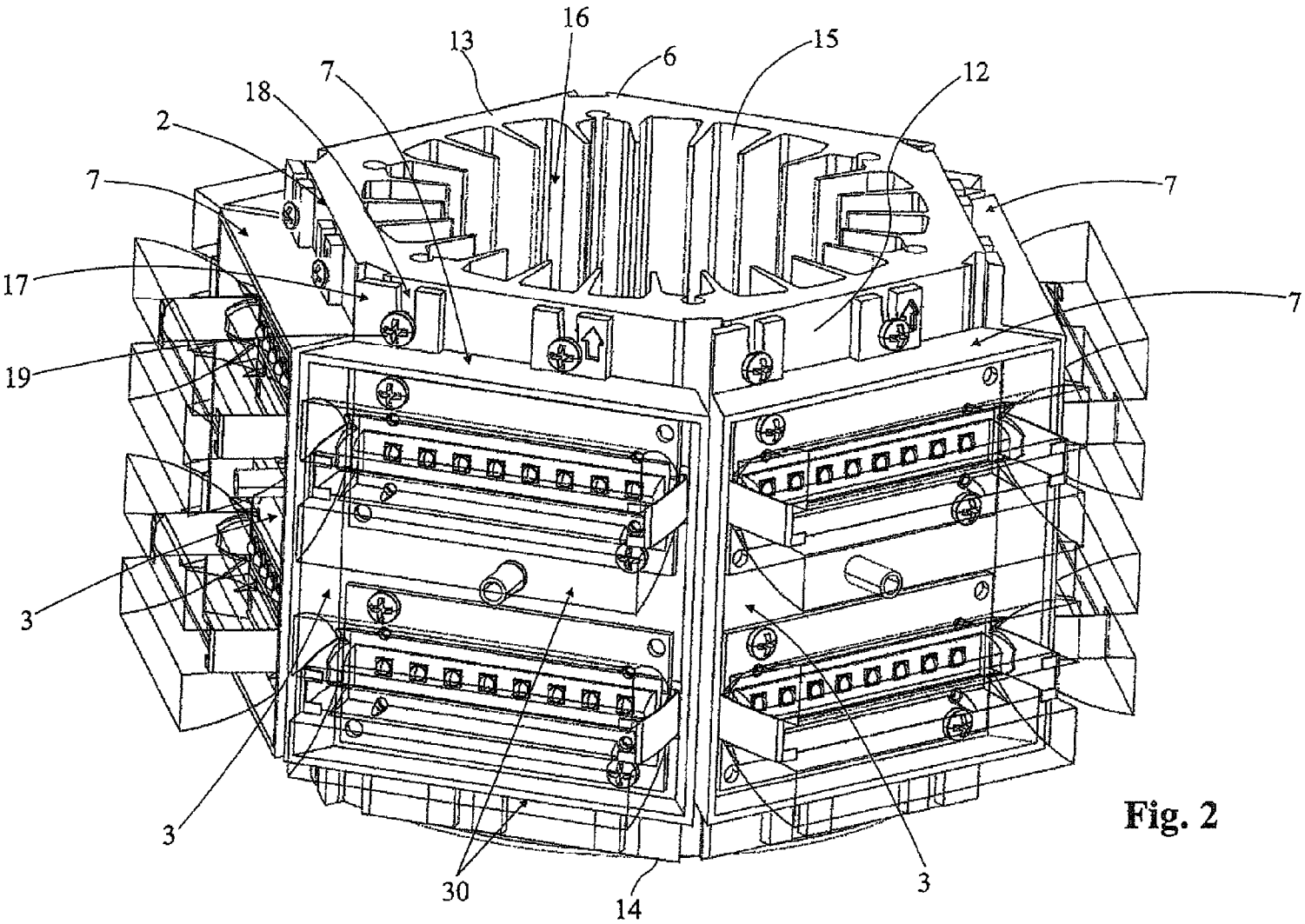
FIG. 2 shows the light indicator illustrated in FIG. 1 with some parts removed in order to better illustrate others.
Figure 3:
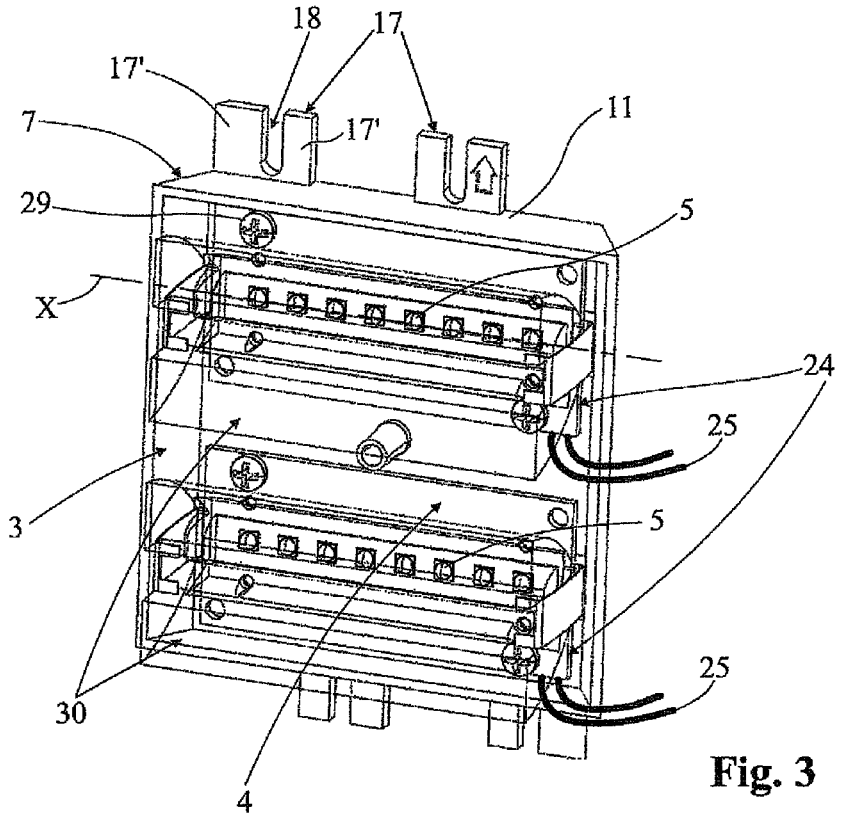
FIG. 3 shows a perspective view of a detail of the indicator, subject of the present finding, relative to the seats in which the LEDs and the lenses are mounted.

In accordance with the embodiment illustrated in FIGS. 1-3, the light indicator 1 comprises multiple rows of LEDs 5 (e.g. two) arranged inside each seat 3 of the support structure 2. Of course, without departing from the protective scope of the present patent, the light indicator 1 can also comprise only one row of LEDs 5 arranged in each seat 3, or more than two rows of LEDs 5 arranged in each seat 3.

Figure 4:
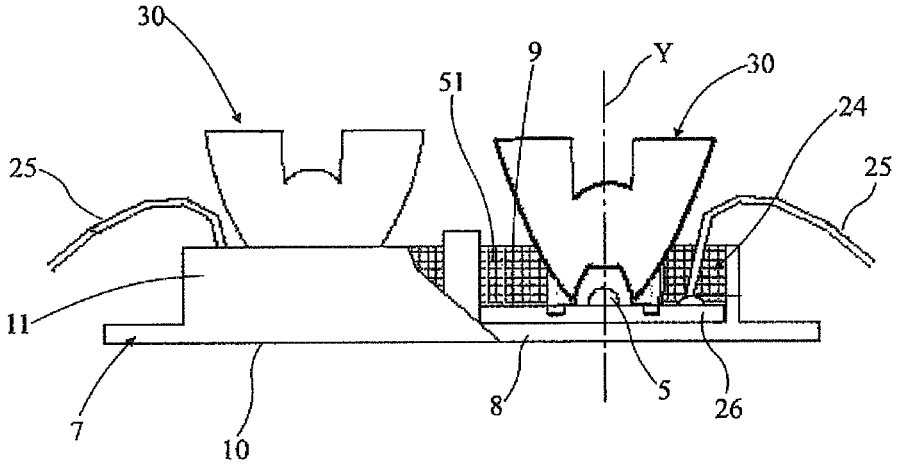
FIG. 4 shows a side view of the detail of the indicator illustrated in FIG. 3, in which some parts have been removed in order to better illustrate others.

Advantageously, in accordance with the embodiment illustrated in the enclosed figures, the support structure 2 of the light indicator 1 comprises a support body 6 and one or more trays 7, each of which delimiting at its interior the corresponding seat 3 in which the LEDs 5 are housed. More in detail, with reference to the embodiment illustrated in FIGS. 3, 4 and 10, each tray 7 comprises a bottom wall 8 provided with an internal face 9 fixed to the support body 6 and with an external face 10 on which the LEDs 5 are fixed. In addition, each tray 7 preferably also comprises multiple side walls 11 extended at an angle from the bottom wall 8 and defining, on the front part, a front opening of the corresponding seat 3 in order to allow the passage of the light emitted by the LEDs 5 towards the indicator 1 exterior.

Advantageously, with reference to the particular embodiment illustrated in FIGS. 1 and 2, the support body 6 has substantially tubular form (in particular with polygonal section, e.g. hexagonal section) and is provided with an external surface 12 on which the aforesaid trays 7 are fixed. In particular, the support body 6, preferably made of metal material (e.g. aluminum), is longitudinally extended with preferably vertical axis between an upper edge 13 thereof and a lower edge 14 thereof, between which the aforesaid external surface 12 is extended, and is also provided with an internal surface 15, which defines an internal channel 16 of the support body 6 itself.

Still with reference to the embodiment illustrated in FIGS. 1 and 2, the light indicator 1 comprises only one row of trays 7 arranged around the external surface 12 of the support body 6. Of course, the present light indicator 1 can also comprise two or more rows of trays 7, arranged on top of each other along the longitudinal extension of the support body 6, without departing from the protective scope of the present patent.

Advantageously, each tray 7 is provided with multiple fixing appendages 17 externally projecting from the side walls parallel to the bottom wall, each provided with at least ODE through opening 18 in which a corresponding first fixing screw 19 is inserted that is screwed with its shank in a corresponding threaded hole obtained on the external surface 12 of the support body 6.

Preferably, each fixing appendage 17 of each tray 7 has a substantially U-shaped form, with two parallel arms 17' that delimit between them the corresponding through opening 18 in which the shank of the corresponding first fixing screw 19 is inserted.

Preferably, in accordance with the embodiment illustrated in FIG. 1, the support structure 2 of the light indicator 1 comprises an upper annular flange 20 and a lower annular flange 21, which are respectively fixed to the upper edge 13 and to the lower edge 14 of the support body 6, in particular by means of retention screws 22, and are each provided with a corresponding central opening aligned with the internal channel 16 of the support body 6 itself.

The light indicator 1 also comprises a cylindrical sheet 23 made of light-permeable material that is placed around the external surface 12 of the support body 6 and is closed on the top and bottom part respectively by the upper 20 and lower 21 annular flange of the support structure 2.

According to the present finding, the light indicator 1 comprises at least one power supply circuit 24 positioned in the corresponding seat 3 and electrically connected to the corresponding LEDs 5 in order to provide electrical power supply to the latter.

Advantageously, each power supply circuit 24 is connected, preferably by means of one or more electrical connection cables 25, to an electronic control unit (not shown) for the light indicator 1 adapted to control the operation of the LEDs 5, preferably in accordance with programmed operating modes.

The control unit is advantageously connected to an electrical energy source (not shown) from which it receives the electric current for supplying power to the LEDs 5 of the light indicator 1.

Advantageously, each power supply circuit 24 of the light indicator 1 comprises an electric circuit board 26 placed inside the corresponding seat 3, provided with a rear face 27 fixed to the support body 6, and with a front face 28 on which the corresponding LEDs 5 are fixed.

Preferably, in accordance with the embodiment illustrated in the enclosed figures, the rear face 27 of each electric circuit board 26 is fixed to the internal face 9 of the bottom wall 8 of the corresponding tray 7, by means of preferably second fixing screws 29.

In accordance with the embodiment illustrated in FIGS. 2 and 3, each tray 7 houses at its interior multiple circuit boards 26, on each of which the corresponding row of LEDs 5 is mounted. Otherwise, in accordance with a different embodiment (not shown), a single electric circuit board 26 is arranged in each tray 7, on which multiple rows of LEDs 5, arranged in such tray 7, are mounted.

Advantageously, the front face 28 of each electric circuit board 26 at least partially defines the base surface 4 of the corresponding seat 3, and on such surface 4 the corresponding LEDs 5 are mounted. In particular, in accordance with the embodiment illustrated in FIGS. 2 and 3, the aforesaid base surface 4 of each seat 3 is defined in part by the front face 28 of the circuit boards 26 arranged in such seat 3, and in part by the portion (not covered by such circuit boards 26) of the internal face 9 of the bottom wall 8' of the corresponding tray 7 which delimits the seat 3 itself.

Advantageously, each electric circuit board 26 comprises a printed circuit, in particular of metal core type, on which metal tracks (not shown) are preferably obtained that are adapted to connect the LEDs 5 mounted on the electric circuit board 26 to the electrical connection cables 25 in order to allow the power supply to the LEDs 5 themselves.

Advantageously, each tray 7 is made of metal material, in particular aluminum, in order to efficiently remove the heat generated by the corresponding LEDs 5 during the operation thereof. In particular, the LEDs 5 transfer the heat generated thereby to the printed circuit of the corresponding electric circuit board 26, which in turn transfers such heat to the tray 7 which transfers the heat via conduction to the support body 6. The latter transmits the heat to the air present in the internal channel 16 of the support body 6 itself. The air thus heated generates an ascending air flow that transports, via convection, the heat received by the support body 6 to outside the light indicator 1.

According to the present finding, the light indicator 1 comprises a collimation lens 30 arranged in the corresponding seat 3 and positioned in front of the corresponding row of LEDs 5 to intercept the light emission axes Y of the LEDs 5 themselves in order to collimate the light emitted by the latter.

Preferably, as described in detail hereinbelow, each lens 30 is fixed on the front face 28 of the electric circuit board 26, on which the corresponding row of LEDs 5 is mounted.

In addition, the light indicator 1 comprises at least one insulating material layer 51 deposited in each seat 3 to cover the corresponding power supply circuit 24 in order to insulate the latter from the inflammable gases of the external atmosphere.

In particular, such insulating material layer 51, preferably comprising a silicone gel, is deposited inside each tray 7, covering the electrical and electronic components of the corresponding circuit boards 26, in a manner such that such components do not generate sparks that can trigger the inflammable gases present in the atmosphere of the area where the light indicator 1 is installed.

Advantageously, the light indicator 1 comprises, in each seat 3, at least two layers of insulating material 51 arranged on top of each other, including at least one more viscous lower layer able to adhere to the power supply circuit 24 and one more rigid upper layer for protecting the lower layer.

According to the present finding, each lens 30 comprises an elongated body 31, which is longitudinally extended between two opposite ends 32 thereof according to an extension direction Z parallel to the alignment direction. X of the corresponding row of LEDs 5. In addition, the elongated body 31 of each lens 30 on the rear part is provided with an abutment portion 33 fixed on the base surface 4 of the corresponding seat 3 and provided with a rear groove 34 parallel to the extension direction Z and housing the corresponding row of LEDs 5 at its interior.

The aforesaid abutment portion 33 of the elongated body 31 of each lens 30 comprises two longitudinal walls 35 that are parallel to each other, which are extended parallel to the extension direction Z and transversely delimit between them the corresponding rear groove 34, and two transverse walls 36 placed to longitudinally close the rear groove 34 itself and preferably arranged orthogonal to the longitudinal walls 35.

The aforesaid longitudinal walls 35 and transverse walls 36 of the abutment portion 33 define a rear edge 37, which delimits an opening of the corresponding rear groove 34 and adheres on the base surface 4 of the corresponding seat 3, closing the aforesaid opening of the rear groove 34, in order to prevent the insulating material 51 from penetrating into the rear groove 34 itself.

The abutment portion 33 of each lens 30 of the light indicator 1 according to the present finding allows protecting the entire row of LEDs 5 arranged in the rear groove 34 from the insulating material 51 arranged in the seat 3 for covering the power supply circuit 24. In particular, during the deposition of the insulating material 51, when the latter is poured in liquid state inside the seat 3 in order to cover the power supply circuit 24, the walls 35, 36 of the abutment portion 33 of the elongated body 31 of each lens 30 prevent the insulating material 51 from penetrating into the rear groove 34 of the lens 30 where the row of LEDs 5 is housed, and hence prevent the deposition on top of the LEDs 5 themselves, distorting the light rays emitted by the latter.

Advantageously, with reference to the embodiment illustrated in FIGS. 1-6, the rear edge 37 of the abutment portion 33 of the elongated body 31 of each lens 30 is fixed in adherence on the front face 28 of the electric circuit board 26, on which the corresponding row of LEDs 5 is mounted.

Otherwise, in accordance with an embodiment not shown in the enclosed figures, the rear edge of each lens adheres to the internal face of the bottom wall of the corresponding tray, with the rear groove of the lens that preferably houses at its interior the entire electric circuit board of the corresponding row of LEDs.

Figure 7:
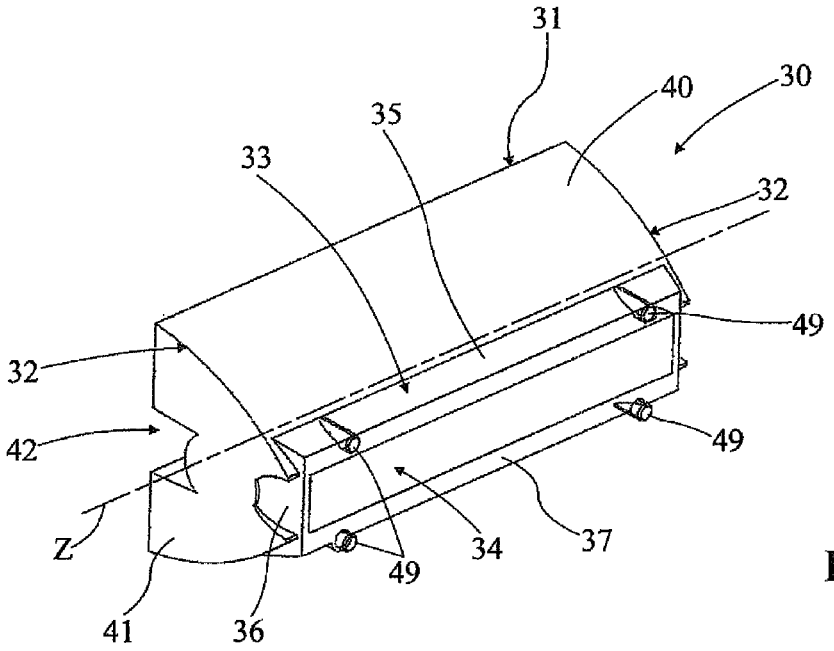
FIG. 7 shows a perspective rear view of a collimation lens of the indicator, subject of the present finding.
Figure 8:
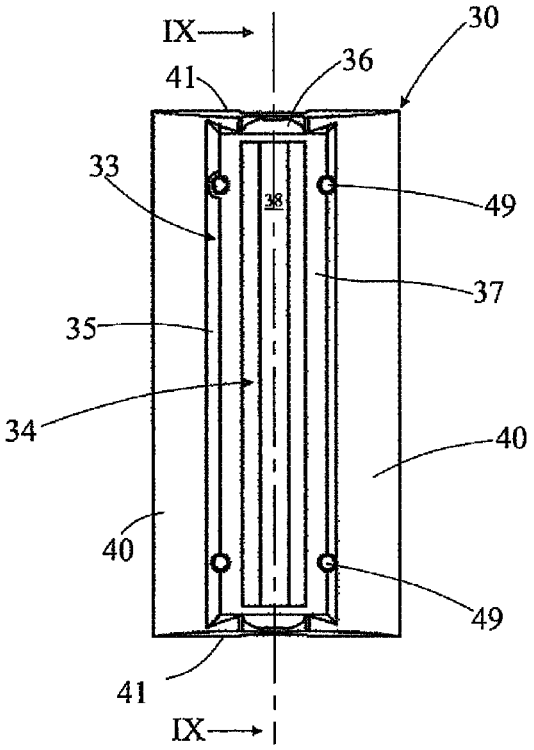
FIG. 8 shows a plan and rear view of the lens illustrated in FIG. 7.
Figure 9:
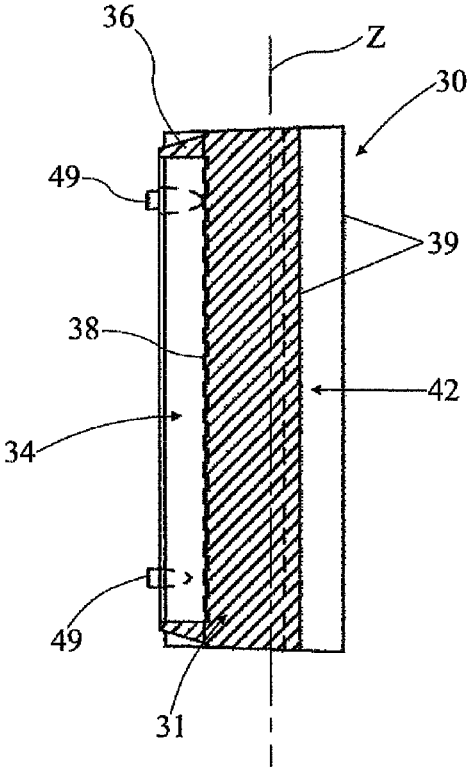
FIG. 9 shows a section view of the lens illustrated in FIG. 8 along the line IX-IX of FIG. 8 itself.

Advantageously, with reference to the embodiment illustrated in FIGS. 7-9, the transverse walls 36 of the abutment portion 33 are each positioned at the respective end 32 of the elongated body 31 of the corresponding lens 30.

In particular, each transverse wall 36 is placed spaced from the respective end 32 of the elongated body 31 of the lens 30, in a slightly recessed position with respect to such end 32. Otherwise, in accordance with a different embodiment not shown in the enclosed figures, the transverse walls are arranged flush with the corresponding ends of the elongated body of the lens.

Advantageously, each lens 30 is made of plastic material, in particular PMMA, and is preferably obtained by means of molding.

Still with reference to the embodiment illustrated in FIGS. 7-9, the elongated body 31 of each lens 30 is provided with a rear surface 38, directed towards the corresponding row of LEDs 5, through which the lens 30 receives in inlet the light emitted by the LEDs 5, and with a front surface 39, directed in the sense opposite that of the rear surface 38 and through which the lens 30 emits beams of collimated light rays.

Advantageously, the rear surface 38 of the elongated body 31 of each lens 30 delimits the bottom of the corresponding rear groove 34 in which the corresponding row of LEDs 5 is housed.

Preferably, the elongated body of each lens comprises two longitudinal surfaces 40, placed to connect between the front surface 39 and the rear surface 38, and in particular with substantially curved form.

The two ends 32 of the elongated body 31 of each lens 30 are closed by two respective lateral surfaces 41, preferably flat, and arranged orthogonal to the extension direction Z of the elongated body 31 itself.

Advantageously, the elongated body 31 of each lens 30 is provided on its front surface 39 with at least one front groove 42 extended between the two ends 32 of the elongated body 31 itself parallel to the extension direction Z, and preferably placed centrally with respect to the front surface 39 itself. In particular, the aforesaid front groove 42 is closed on the bottom by a curved and convex portion of the front surface 39, and the remaining portions of the front surface 39 of the elongated body 31 of the lens 30, arranged along two longitudinal sides of the front groove 42, have a flat form.

Preferably, the abutment portion 33 of the elongated body 31 of each lens 30 is extended projecting from the longitudinal surfaces 40 of the elongated body 31 and advantageously is extended tapering towards the corresponding rear edge 37.

In particular, each longitudinal wall 35 and transverse wall 36 of the abutment portion 33 is provided with a corresponding external side tilted towards the center of the lens 30.

The tapered form of the abutment portion 34 of the elongated body 31 of each lens 30 allows considerably limiting the number of the right-angle inlets of the molds for the production of the lens 30 itself: at such inlets, as is known to the man skilled in the art, are bubbles susceptible of remaining during the molding process. Hence, this involves greater efficiency of the lens 30 production process.

Advantageously, the light indicator 1 comprises at least two coupling bodies 43, each arranged at the respective end 32 of the elongated body 31 of each lens 30 in order to retain the latter integral with the corresponding electric circuit board 26 on which it is mounted.

Figure 5:
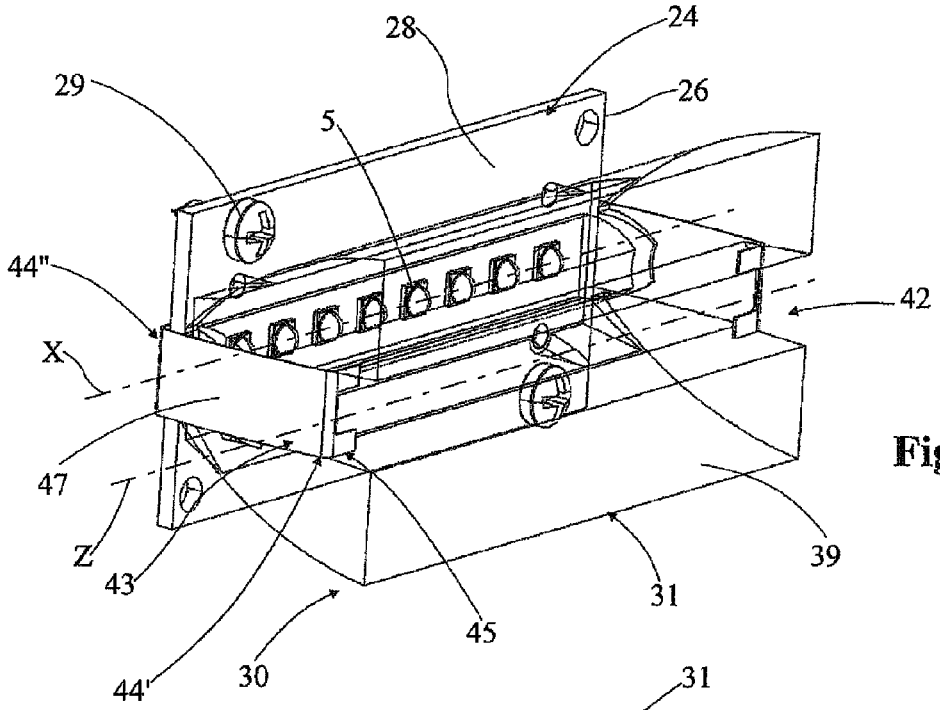
FIGS. 5 and 6 respectively show a perspective front view and a perspective rear view of a detail of the light indicator, subject of the present finding, relative to a row of LEDs with the corresponding light collimation lens associated therewith.
Figure 6:
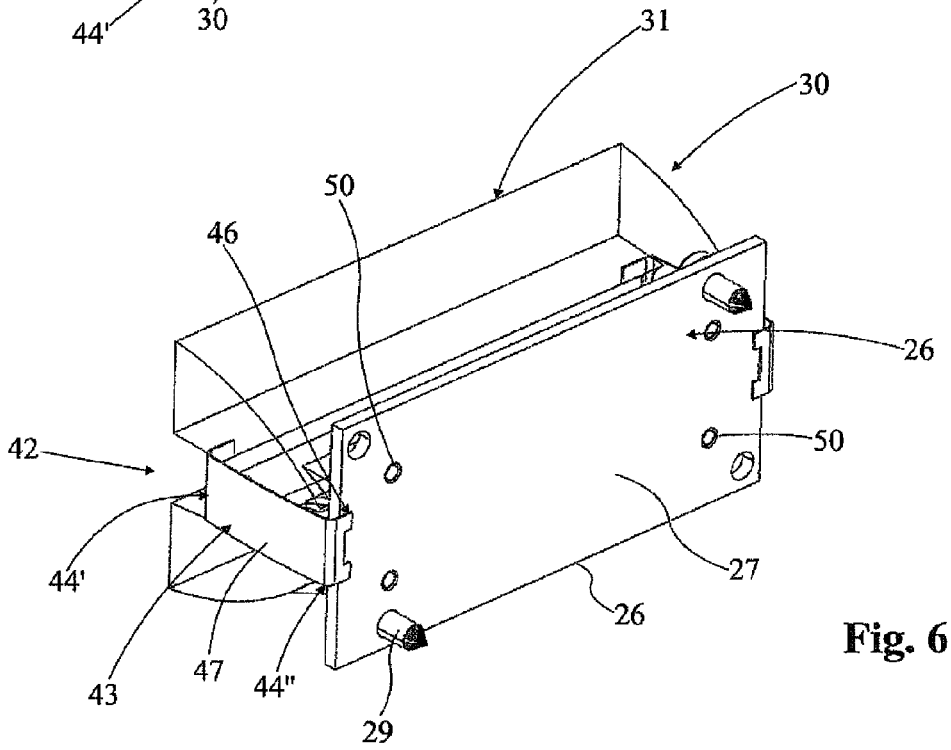

More in detail, with reference to the embodiment illustrated in FIGS. 5 and 6, each coupling body 43 is extended between two ends 44', 44" thereof at which it is provided with respective bent portions 45, 46, of which a first bent portion 45 is engaged with the front surface 39 of the corresponding lens 30, and a second bent portion 46 is engaged with the rear face 27 of the corresponding electric circuit board 26.

Preferably, the first bent portion 45 of each coupling body 43 is inserted in the front groove 42 of the elongated body 31 of the respective lens 30 at the respective end 32 of the elongated body 31 itself. The front groove 42 is advantageously open at the ends 32 of the elongated body 31 in order to allow the insertion of the first bent portions 45 of the coupling bodies 43.

In particular, the first bent portion 45 of each coupling body 43 is inserted in the front groove 42 of the elongated body 31 from the corresponding end 32 of the latter, being anchored on the portion of the front surface 39 of the elongated body 31 that delimits the bottom of the front groove 42 itself.

Advantageously, with reference to the embodiment illustrated in FIGS. 5 and 6, each coupling body 43 is provided with a central portion 47 placed to connect between its two bent portions 45, 46. Such central portion 47 is provided with an internal side directed towards the corresponding end 32 of the elongated body 31 of the lens 30, from which the two bent portions 45, 46 are projectingly extended, and with an external side directed in the sense opposite that of the internal side.

Advantageously, each coupling body 43 is made of elastically flexible material and is in particular obtained with a metal plate bent at its ends 44', 44". Preferably, each bent portion 45, 46 of the coupling body 43 delimits, with the internal side of the central portion 47, an angle less than or equal to 90°, in order to allow the first and the second bent portion 45, 46 to be coupled respectively to the lens 30 and to the electric circuit board 26.

Preferably, the first and the second bent portion 45, 46 of each coupling body 43 are elastically deformed in moving away from each other, respectively from the front surface 39 of the elongated body 31 of the lens 30 and from the rear face 27 of the electric circuit board 26.

In this manner, advantageously, the first and the second bent portion 45, 46 of the coupling body 43, when they are engaged with the corresponding lens 30, are each subjected to an elastic reaction force that tends to push them respectively against the front surface 39 of the elongated body 31 and the rear face 27 of the electric circuit board 26, in this manner retaining the lens 30 integral with the electric circuit board 26 itself.

Advantageously, each bent portion 45, 46 of each, coupling body 43 comprises two corresponding appendages that are parallel and spaced from each other, and extended along the two opposite longitudinal profiles of the coupling body 43 itself.

Figure 10:
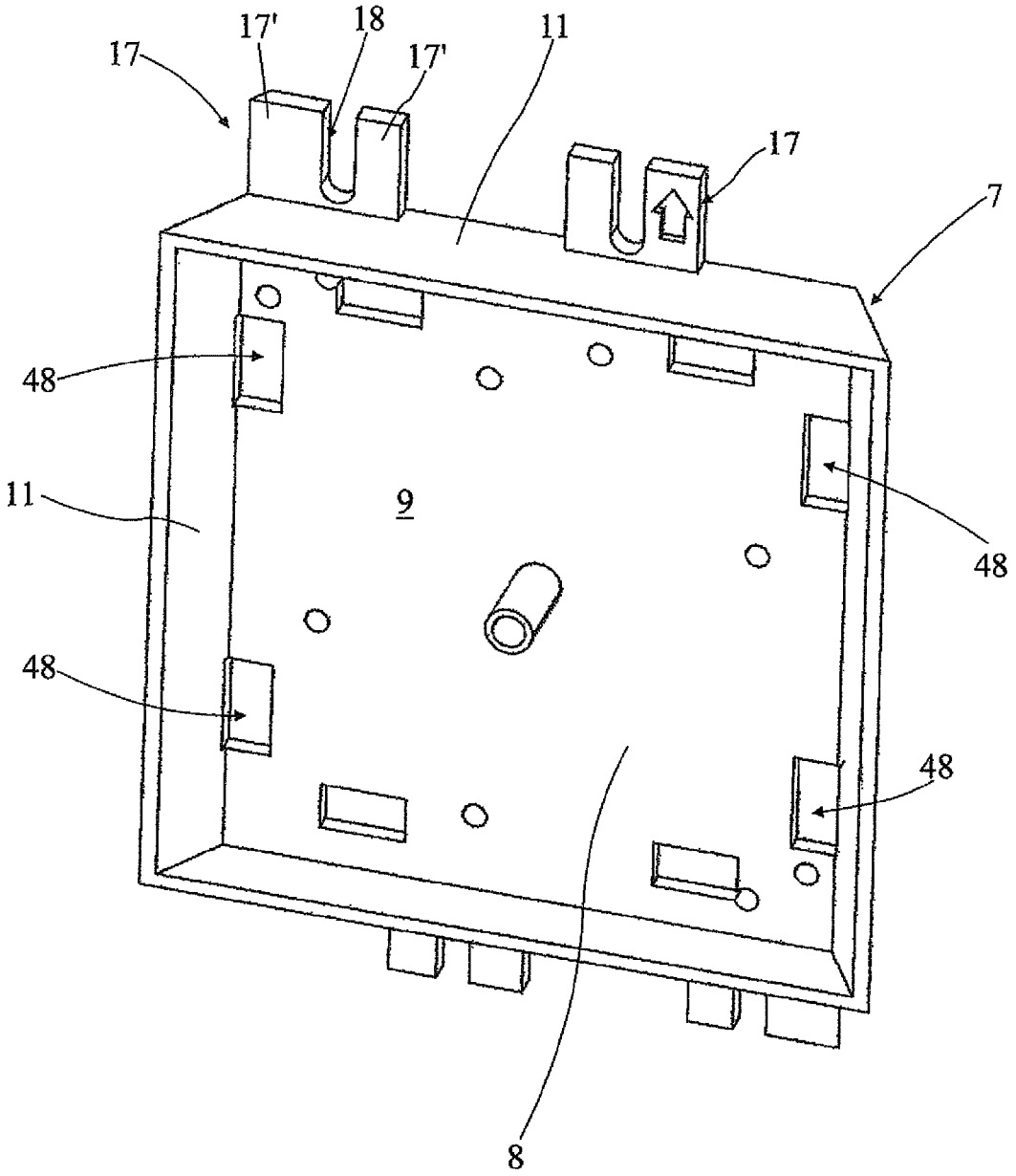
FIG. 10 shows a detail of the light indicator, subject of the present finding, relative to a tray defining, at its interior, the seat in which the LEDs and the lenses are housed of the indicator itself.

Advantageously, with reference to the embodiment illustrated in FIG. 10, the internal face 9 of the bottom wall 8 of each tray 7 of the light indicator 1 is provided with multiple housing cavities 48 arranged at the edge of each electric circuit board 26, at least partially extended behind the rear face 27 of the electric circuit board 26 itself, in order to house the second bent portions 46 of the coupling bodies 43.

Advantageously, each of such housing cavities 48 is extended to outside the edge of the electric circuit board 26 in order to allow the insertion of the second bent portion 46 of the corresponding coupling body 43 in the cavity 48 itself.

Such housing cavities 48 advantageously allow engaging the second bent portions 46 of the coupling bodies 43 with the rear face 27 of the electric circuit board 26, at the same time allowing the adhesion of such rear face 27 to the internal face 9 of the bottom wall 8 of the corresponding tray 7, in a manner such to facilitate the thermal transmission of the heat (produced by the LEDs 5) between the electric circuit board 26 and the tray 7 with a consequent efficient heat removal.

In operation, in order to mount the LEDs 5 and the lenses 30 on the light indicator 1, the operator preferably fixes each electric circuit board 26 (with the corresponding LEDs 5 mounted thereon) to the internal face 9 of the bottom wall 8 of the corresponding tray 7 by means of the first fixing screws 19, and subsequently inserts the second ends 32 of the coupling bodies 43 in the corresponding housing cavities 48.

Afterward, the operator bends the central portion 47 of each coupling body 43 towards its external side and arranges the lens 30 on the electric circuit board 26 in front of the corresponding row of LEDs 5. Then, the operator releases the central portion 47 of the coupling bodies 43 which, by elastic return, bears the corresponding first bent portion 45 in abutment against the front surface 39 of the elongated body 31 of the lens 30, inserting such first bent portion 45 within the front groove 42 of the elongated body 31 of the lens 30, in order to retain it integral with the electric circuit board 26.

Advantageously, the abutment portion 33 of the elongated body 31 of each lens 30 is provided with projecting pins 49 inserted in corresponding holes 50 of the electric circuit board 26 in order to position the lens 30 with its extension axis Z parallel to the alignment direction X of the corresponding row of LEDs 5.

The finding thus conceived therefore achieves the aforesaid objects.

The invention claimed is:

1. Light indicator (1), which comprises:

a support structure (2) provided with at least one concave seat (3) delimited on the bottom by a base surface (4) that is at least partially flat;

at least one row of LEDs (5) mounted on said base surface (4), arranged substantially aligned with each other along an alignment direction (X) substantially parallel to said base surface (4), each LED provided with its light emission axis (Y) substantially orthogonal to said base surface (4);

at least one power supply circuit (24) positioned in said seat (3) and electrically connected to said LEDs (5) in order to provide electrical power supply to the latter;

at least one collimation lens (30) at least partially arranged in said seat (3) and positioned in front of said row of LEDs (5) to intercept the light emission axes (Y) of said LEDs (5) in order to collimate the light emitted by the latter;

at least one insulating material layer (51) deposited in said seat (3) to cover said power supply circuit (24);

said lens (30) comprising an elongated body (31), which is longitudinally extended between two opposite ends (32) thereof according to an extension direction (Z) parallel to said alignment direction (X) of the row of said LEDs (5), and on the rear part is provided with an abutment portion (33) fixed on said base surface (4) and provided with a rear groove (34) parallel to said extension direction (Z) and housing said row of LEDs (5) at its interior;

said abutment portion (33) comprising two longitudinal walls (35) substantially parallel to each other, which are extended parallel to said extension direction (Z) and delimit between them said rear groove (34), and two transverse walls (36) placed to longitudinally close said rear groove (34);

said longitudinal walls (35) and transverse walls (36) defining a rear edge (37), which delimits an opening of said rear groove (34) and adheres to said base surface (4), closing the opening of said rear groove (34) in order to prevent said insulating material (51) from penetrating into said rear groove (34).

2. Light indicator (1) according to claim 1, characterized in that the transverse walls (36) of said abutment portion (33) are each positioned at the respective end (32) of said elongated body (31).

3. Light indicator (1) according to claim 1, characterized in that said abutment portion (33) is extended tapering towards said rear edge (37).

4. Light indicator (1) according to claim 1, characterized in that said support structure (2) comprises a support body (6) and at least one tray (7), which delimits said seat (3) at its interior and comprises a bottom wall (8) provided with an external face (10) fixed to said support body (6) and with an internal face (9) on which said LEDs (5) are fixed.

5. Light indicator (1) according to claim 4, characterized in that said support body (6) has substantially tubular form and is provided with an external surface (12) on which multiple said trays (7) are fixed.

6. Light indicator (1) according to claim 4, characterized in that said tray (7) comprises multiple side walls (11) extended at an angle from said bottom wall (8), and also comprises fixing appendages (17) externally projecting from at least one of said side walls (11) parallel to said bottom wall (8), and each provided with at least one through opening (18) in which a corresponding first fixing screw (19) is inserted that is screwed with its shank in a corresponding threaded hole obtained on said support body (6).

7. Light indicator (1) according to claim 4, characterized in that said tray (7) is made of metal material, in particular aluminum.

8. Light indicator (1) according to claim 1, characterized in that said power supply circuit (24) comprises an electric circuit board (26), provided with a rear face (27) fixed to said support body (6) inside said seat (3), and with a front face (28) on which said LEDs (5) are fixed; said front face (28) at least partially defining said base surface (4).

9. Light indicator (1) according to claim 8, characterized in that said support structure (2) comprises a support body (6) and at least one tray (7), which delimits said seat (3) at its interior and comprises a bottom wall (8) provided with an external face (10) fixed to said support body (6) and with an internal face (9) on which said LEDs (5) are fixed, wherein the rear face (27) of said electric circuit board (26) is fixed to the internal face (9) of the bottom wall (8) of said tray (7).

10. Light indicator (1) according to claim 8, characterized in that the rear edge (37) of the abutment portion (33) of the elongated body (31) of said lens (30) is fixed in adherence on the front face (28) of said electric circuit board (26).

11. Light indicator (1) according to claim 8, characterized in that said electric circuit board (26) comprises at least one printed circuit.

12. Light indicator (1) according to claim 8, characterized in that the elongated body (31) of said lens (30) is provided with a rear surface (38) directed towards said LEDs (5) and with a front surface (39) directed in the sense opposite that of said rear surface (38);

said light indicator (1) comprising at least two coupling bodies (43) each arranged at the respective end (32) of the elongated body (31) of said lens (30) in order to retain the latter integral with said electric circuit board (26);

each said coupling body (43) extended between two ends (44', 44") thereof at which it is provided with bent portions (45, 46), of which a first bent portion (45) is engaged with the front surface (39) of said lens (30), and a second bent portion (46) is engaged with the rear face (27) of said electric circuit board (26).

13. Light indicator (1) according to claim 12, characterized in that the elongated body (31) of said lens (30) is provided on said front surface (39) with at least one front groove (42) extended between the two ends (32) of said elongated body (31) parallel to said extension direction (Z);

the first bent portion (45) of each said coupling body (43) being inserted in said front groove (42) at the respective end (32) of said elongated body (31).

14. Light indicator (1) according to claim 12, characterized in that said coupling body (43) is provided with a central portion (47) which is placed to connect between said bent portions (45, 46), and is provided with an internal side directed towards the respective end (32) of the elongated body (31) of said lens (30), from which said bent portions (45, 46) are projectingly extended.

15. Light indicator (1) according to claim 14, characterized in that each bent portion (45, 46) of said coupling body (43) delimits, with the internal side of said central portion (47), an angle less than or equal to 90°.

16. Light indicator (1) according to claim 12, characterized in that each said coupling body (43) is made of elastically flexible material.

17. Light indicator (1) according to claim 16, characterized in that each said coupling body (43) is obtained with a metal plate bent at said ends (44', 44").

18. Light indicator (1) according to claim 12, characterized in that each said bent portion (45, 46) comprises at least two corresponding appendages that are parallel and spaced from each other.

19. Light indicator (1) according to claim 12, characterized in that said power supply circuit (24) comprises an electric circuit board (26), provided with a rear face (27) fixed to said support body (6) inside said seat (3), and with a front face (28) on which said LEDs (5) are fixed; said front face (28) at least partially defining said base surface (4), wherein said support structure (2) comprises a support body (6) and at least one tray (7), which delimits said seat (3) at its interior and comprises a bottom wall (8) provided with an external face (10) fixed to said support body (6) and with an internal face (9) on which said LEDs (5) are fixed, wherein the rear face (27) of said electric circuit board (26) is fixed to the internal face (9) of the bottom wall (8) of said tray (7), wherein the internal face (9) of the bottom wall (8) of said tray (7) is provided with at least two housing cavities (48) arranged at the edge of said electric circuit board (26) and at least partially extended below the rear face (27) of said electric circuit board (26); in each of said housing cavities (48) being inserted the second bent portion (46) of the corresponding said coupling body (43).

* * * * *